US007412856B1

(12) United States Patent
Gogel

(10) Patent No.: US 7,412,856 B1
(45) Date of Patent: Aug. 19, 2008

(54) LOCK GUARD FOR LONG SHACKLE PADLOCK OVER HANDLE

(76) Inventor: Roy E. Gogel, Suite C-1, 319 Garlington Rd., Greenville, SC (US) 29615

( * ) Notice: Subject to any disclaimer, the term of this patent is extended or adjusted under 35 U.S.C. 154(b) by 0 days.

(21) Appl. No.: 11/876,077

(22) Filed: Oct. 22, 2007

Related U.S. Application Data

(60) Provisional application No. 60/855,976, filed on Nov. 1, 2006.

(51) Int. Cl.
*E05B 67/38* (2006.01)

(52) U.S. Cl. ..... 70/56; 70/203; 70/212; 292/218; 292/DIG. 32

(58) Field of Classification Search ..... 70/54–56, 70/417, DIG. 43, DIG. 56, 202, 203, 211, 70/212; 292/DIG. 32, 148, 205, 218, 281, 292/283, 285; D8/334, 335, 346
See application file for complete search history.

(56) References Cited

U.S. PATENT DOCUMENTS

| | | | | |
|---|---|---|---|---|
| 1,244,404 | A | 10/1917 | Ankovitz | |
| 1,248,293 | A | 11/1917 | Ellington | |
| 4,581,907 | A | 4/1986 | Eberly | 70/54 |
| 4,898,008 | A | 2/1990 | Eberly | 70/56 |
| 5,118,149 | A | 6/1992 | Emmons | 292/327 |
| 5,477,710 | A * | 12/1995 | Stefanutti | 70/56 |
| 5,737,946 | A * | 4/1998 | Sole et al. | 70/54 |
| 6,009,731 | A | 1/2000 | Emmons et al. | 70/56 |
| 6,010,166 | A | 1/2000 | Hamilton et al. | 292/282 |
| 6,357,266 | B1 | 3/2002 | Van Buren | 70/56 |
| 6,494,064 | B1 * | 12/2002 | Pena | 70/56 |
| 6,519,982 | B1 | 2/2003 | Brammall et al. | 70/56 |
| 6,581,419 | B1 | 6/2003 | Strodtman | 70/56 |
| 6,622,533 | B1 | 9/2003 | Santini | 70/56 |
| 6,983,629 | B1 * | 1/2006 | Gogel | 70/14 |
| 7,162,898 | B2 * | 1/2007 | Gogel | 70/14 |
| 7,201,027 | B2 * | 4/2007 | Gogel | 70/56 |
| 7,201,028 | B1 * | 4/2007 | Gogel | 70/56 |
| 7,278,284 | B1 * | 10/2007 | James | 70/56 |
| 2004/0107744 | A1 * | 6/2004 | Chen | 70/2 |
| 2004/0221626 | A1 * | 11/2004 | Palzkill et al. | 70/34 |
| 2005/0056062 | A1 * | 3/2005 | Gogel | 70/56 |

* cited by examiner

*Primary Examiner*—Lloyd A Gall
(74) *Attorney, Agent, or Firm*—Joseph T. Guy; Nexsen Pruet, LLC

(57) ABSTRACT

Two embodiments of a guard are provided for protecting a padlock securing stanchion levers in their door locking position. An opening in the front wall of the guard permits its use with padlocks having long shackles as well as those with regular length shackles while retaining the compactness not normally retained for the extended length of the shackles. The preferred construction lock guard has a pitched roof and a pair of legs on its laterally outer sides extending downwardly behind the stanchion lever at laterally opposite sides of the stanchion latching mechanism that increase stability, rigidity of the housing and protection of the latches.

10 Claims, 8 Drawing Sheets

LOCK GUARD FOR LONG SHACKLE PADLOCK OVER HANDLE

RELATED APPLICATIONS

Applicant claims the benefit of U.S. provisional patent application 60/855,976 filed Nov. 1, 2006, for a Lock Guard for Long Shackle Padlock Over Handle.

BACKGROUND OF THE INVENTION

Thieves who break into moving vans, tractor trailers and other cargo containers use a variety of tools such as sledge hammers, acetylene cutting torches, saws, grinders and the like. The bolt cutter is a favored tool of burglars for cutting padlocks because of its portability and reduced time, light and sound generation; thus there is a need to protect padlocks used on containers, moving vans, semi-trailers, truck trailer units and storage facilities. Tractor trailers with twin rear doors are secured by a pair of vertical stanchions, at least one of which has a locking handle or lever, which is normally secured by padlock to prevent rotation of the stanchion, thus maintaining the doors in a locked condition. It is also desirable to provide protection for padlocks securing similar operating levers of doors of containers or storage facilities. It is desirable to keep the lock guard relatively small to make it more difficult for thieves to access the lock. Additionally, it is important to some container owners, due to the high value or sensitivity of their loads, to shield the retainer catch and pivoted locking latch because those components can be cut to gain entry while leaving the lock untouched.

BACKGROUND ART

Various attempts have been made to protect padlocks securing stanchion locking levers for roll-up doors and the like. U.S. patents showing devices attempting to protect padlocks include Eberly U.S. Pat. Nos. 4,581,907 and 4,898,008; Ankovitz U.S. Pat. No. 1,224,404; Ellington U.S. Pat. No. 1,248,293; Sole U.S. Pat. No. 5,737,946; Santini U.S. Pat. No. 6,622,533; Stroudtman U.S. Pat. No. 6,581,419; Brammall U.S. Pat. No. 6,519,982; Hamilton U.S. Pat. No. 6,010,166; Emmons U.S. Pat. Nos. 5,118,149 and 6,009,731; Van Buren U.S. Pat. No. 6,357,266 and Gogel U.S. Pat. Nos. 7,201,027 and 7,201,028. The rear wall of the lock guard of Santini U.S. Pat. No. 6,622,533 includes a back wall having a pair of handle engaging members used to hook the lock guard to the locking handle.

SUMMARY OF THE INVENTION

The herein disclosed lock guard shrouds the padlock's shackle when fully engaged and secured so as to protect the lock from unauthorized tampering when securing a semi-trailer or container door in its closed position. The security device allows the door to be secured with both a padlock and said lock guard in seconds. The relatively long vertical length of the guard envelops and protects the retainer catch and latch and locking the guard's downwardly extending securing tabs at its laterally opposite sides extending below and behind the locking handle secures the guard in its protecting position. The lock guard has a pitched roof to deflect physical attack. By providing a latching abutment and a narrow vertical slot in the front wall, the lock guard can be used in conjunction with a longer shackled padlock without providing the normal offset in expanded fore and aft width. It allows the insertion of the longer shackle into a locking tab hole in a functionally and significantly smaller housing dimension. The slot's design is sufficiently narrow as to prevent insertion of an adult human finger and the overall design is such that fingers and hands are not only not needed for inclusion of the lock in the guard on the secured enclosure but also thwarted by its compact design. Additionally, the lock guard is fully portable and does not require a time sensitive feeding of the locking handle through the guard, as required by a prior art guard. The device capitalizes on the hinged shackle of the padlock. The guard is not directly secured to the door. It does allow for a broader range of length of padlock shackles, it does engulf and protect the lock's shackles, and independent movement of the guard is severely retarded by the securing tabs that are slid behind the door's locking handle and which work in concert with both the locking handle and the associated padlock to thwart excessive movement.

BRIEF DESCRIPTION OF THE DRAWINGS

The invention is illustrated in the accompanying drawings, in which.

DETAILED DESCRIPTION OF THE INVENTION

Figure 1:
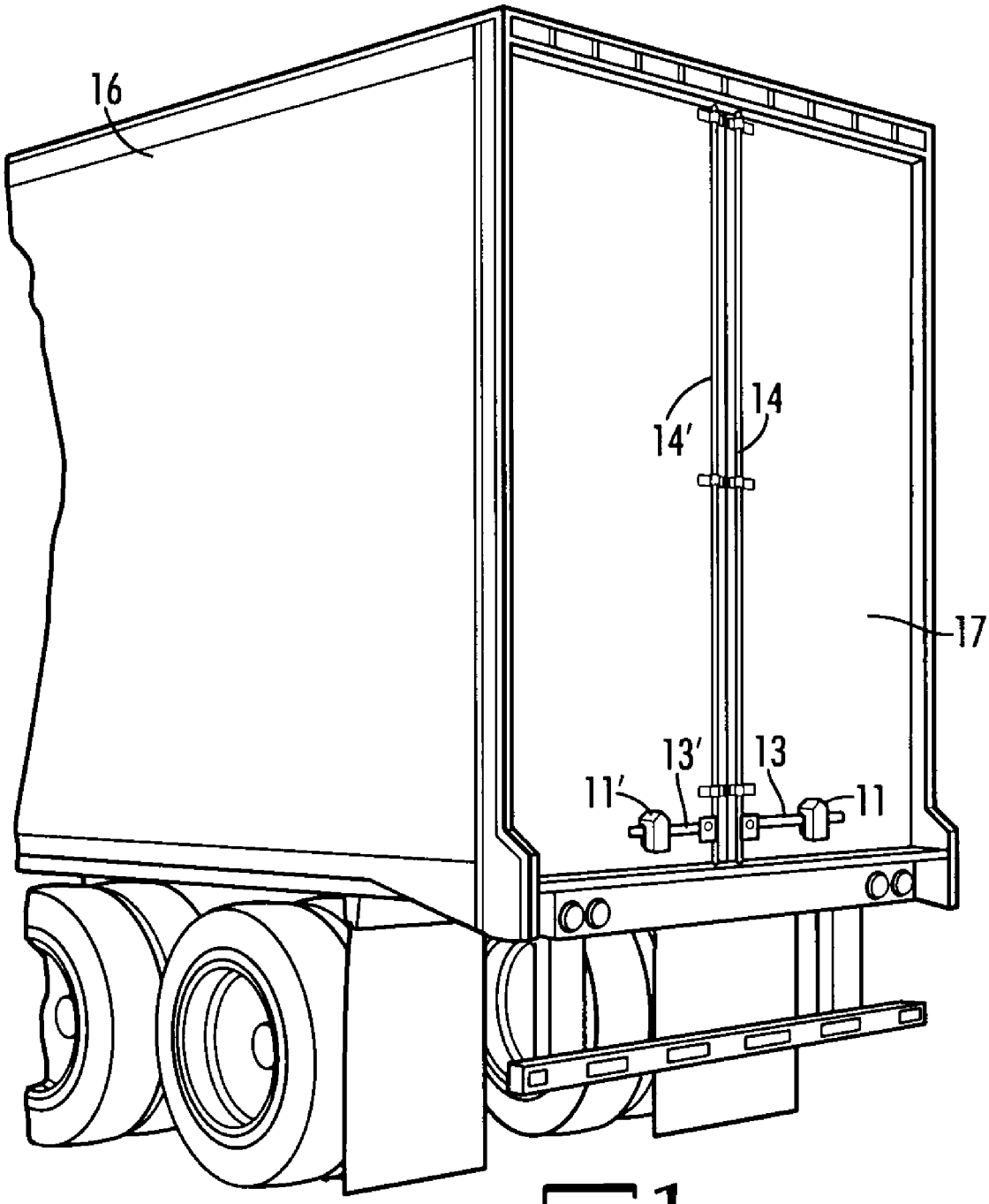
FIG. 1 is a perspective showing the rear doors of a semi-trailer secured by stanchions, one of which has an operating lever secured by a lock protected by a lock guard of this invention.
Figure 2:
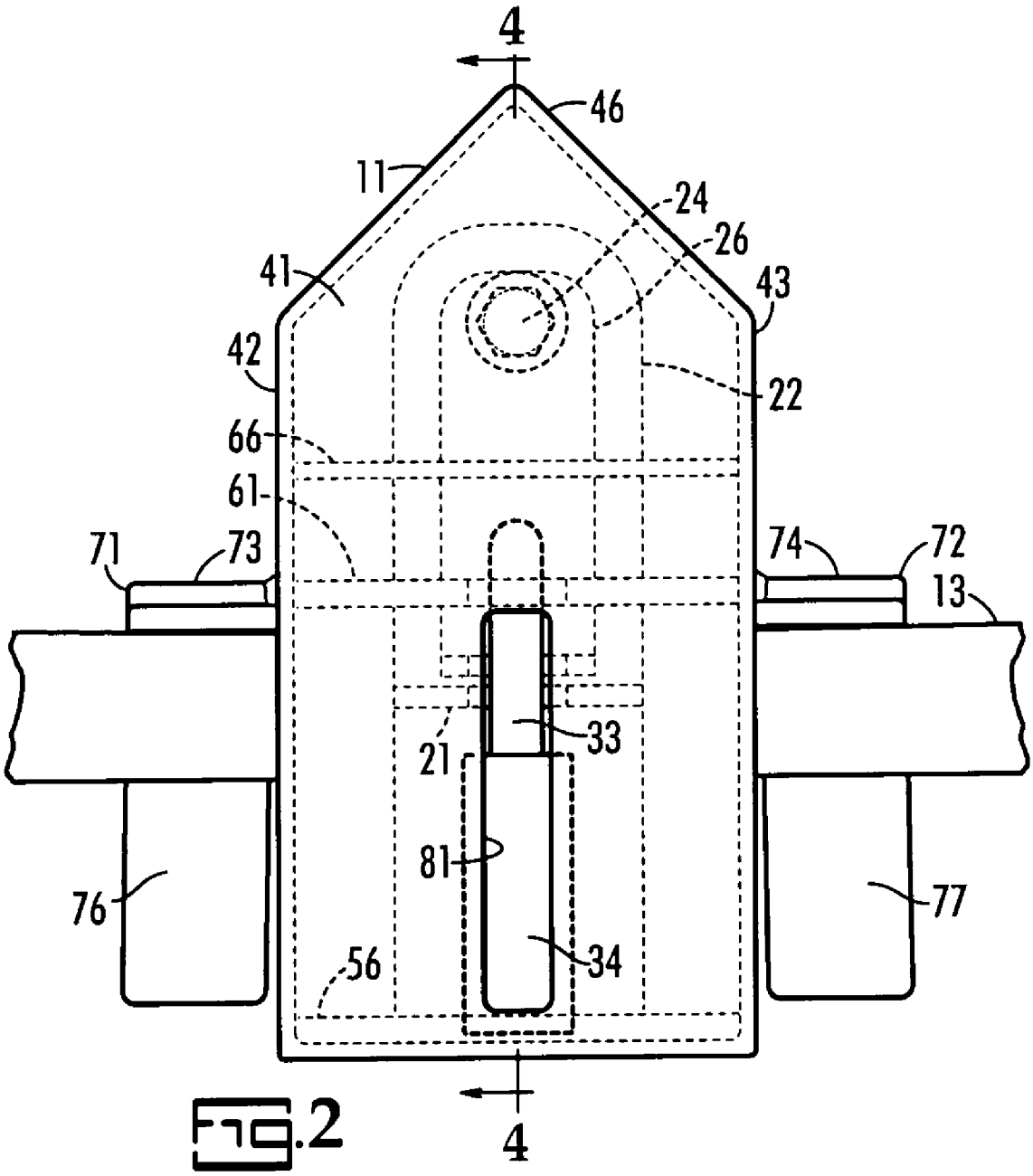
FIG. 2 is a front view of the installed lock guard shown in FIG. 1.
Figure 3:
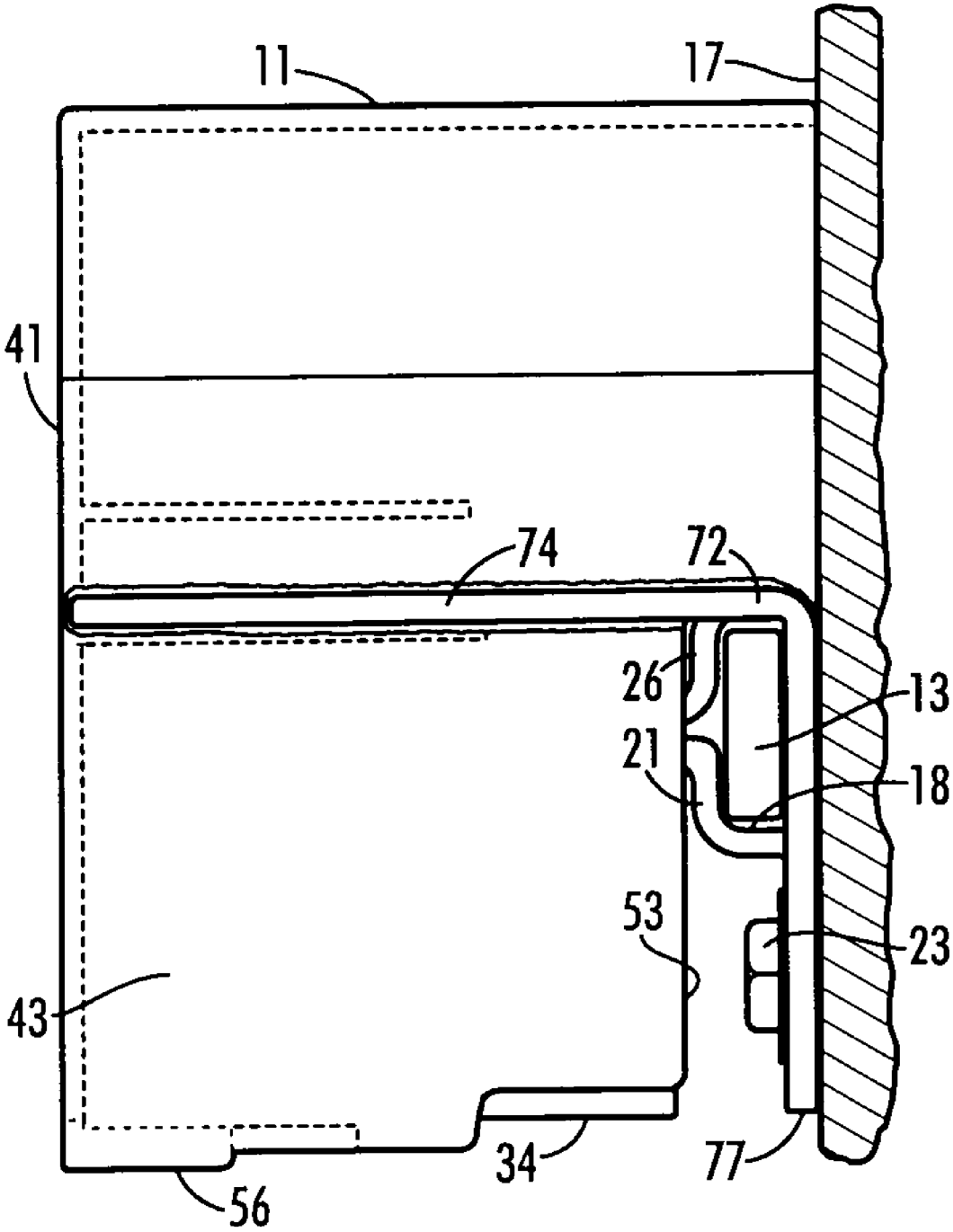
FIG. 3 is a side view of the installed lock guard shown in FIG. 2.
Figure 4:
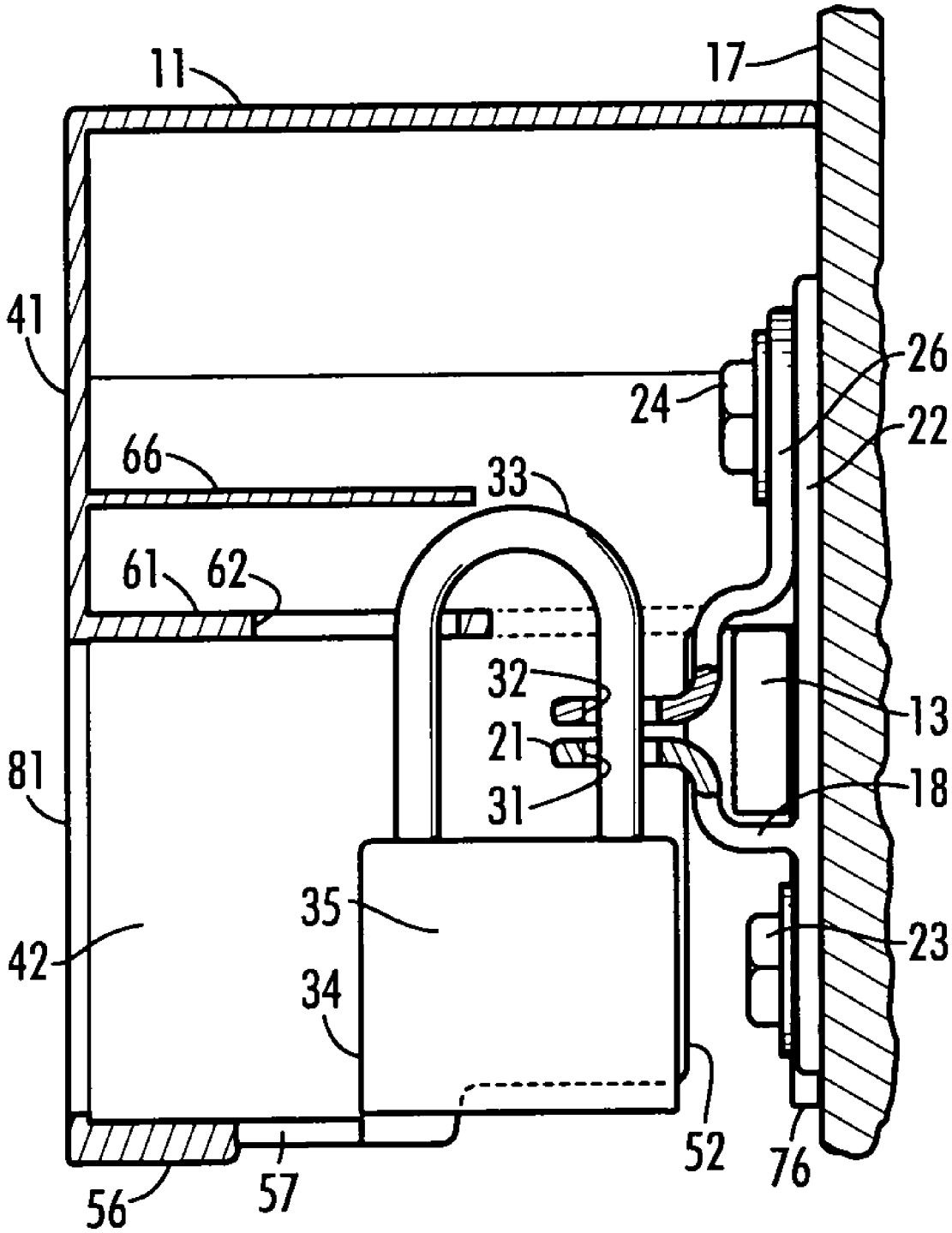
FIG. 4 is a section taken on line 4-4 in FIG. 2.
Figure 5:
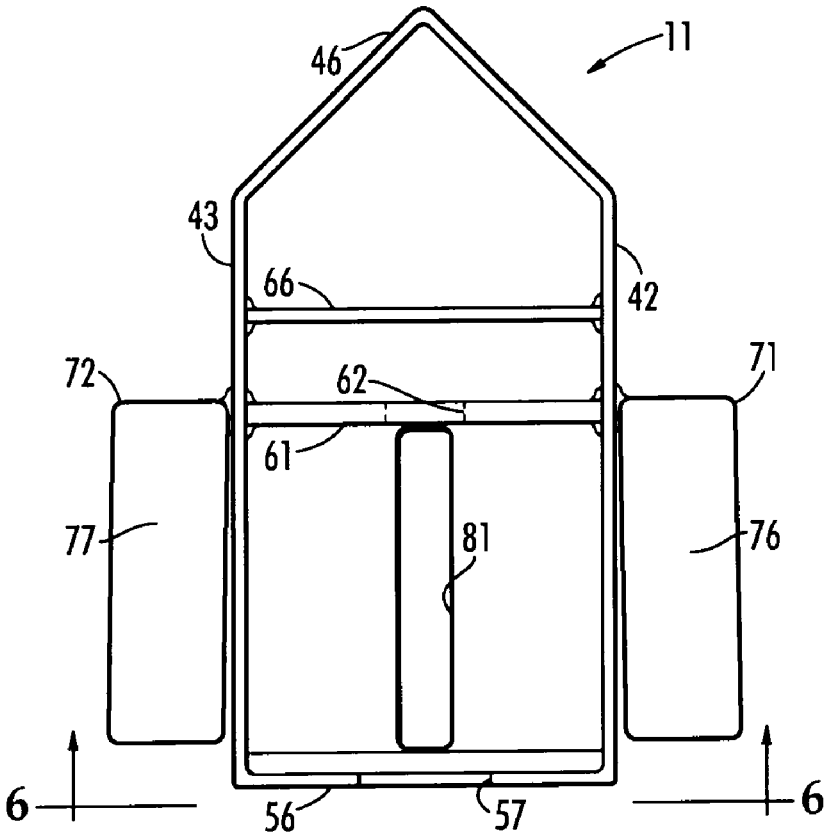
FIG. 5 is a rear view of the lock guard shown in FIG. 2.
Figure 6:
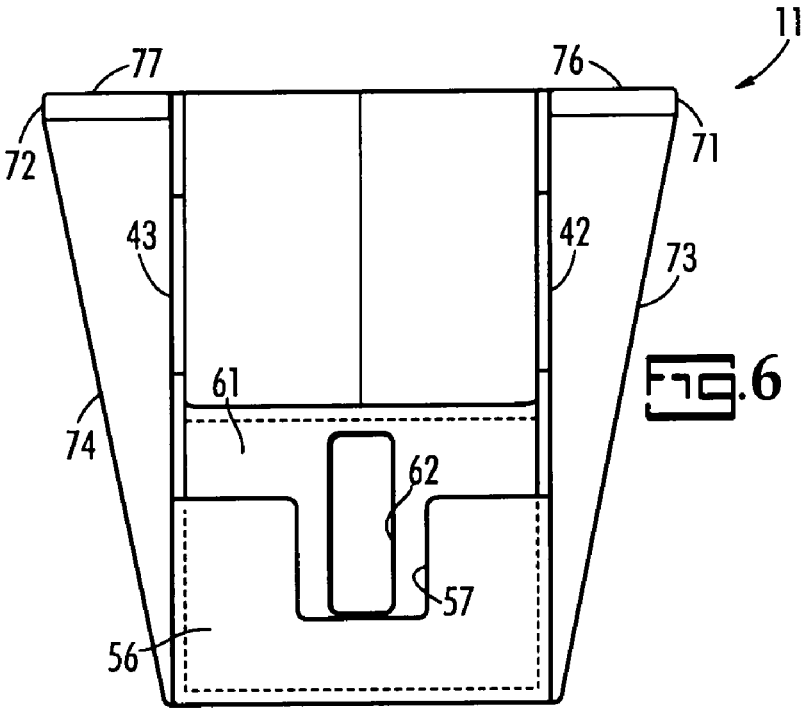
FIG. 6 is a bottom view of the lock guard shown in FIG. 2.
Figure 7:
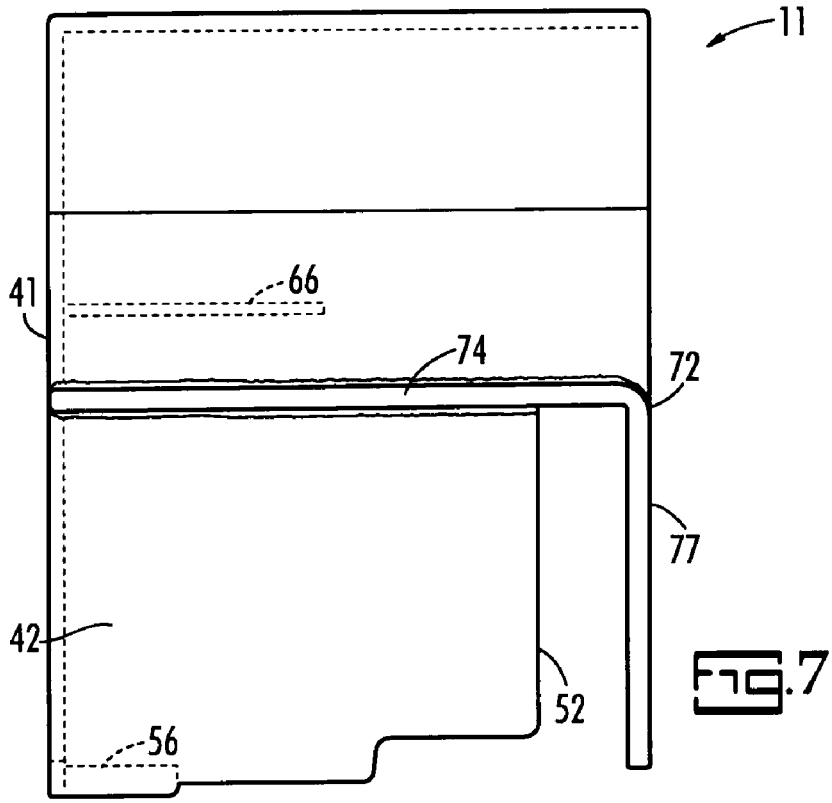
FIG. 7 is a side view of the lock guard shown in FIG. 2.
Figure 10:
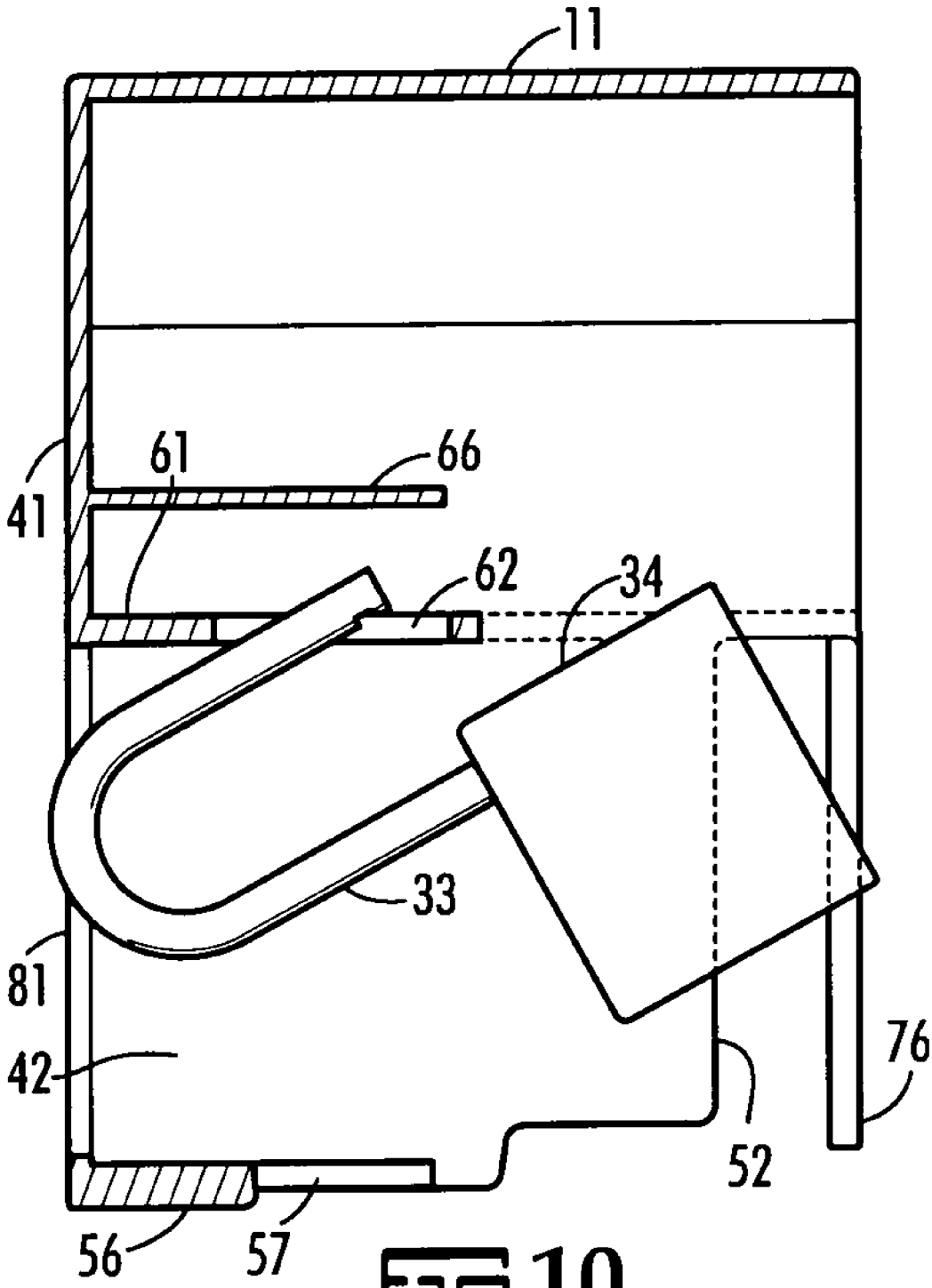
FIG. 10 is a vertical section showing a padlock being connected to the lock guard of FIGS. 2 through 7.

The lock guard 11 shown in FIGS. 1 through 7 and 10 has particular utility in protecting a lock shackle padlock 34 securing an operating lever 13 pivotally connected to a vertical stanchion 14 of a semi-trailer 16 shown in FIG. 1. As illustrated, a stanchion lever 14' also has an operating lever 13' and a lock guard 11'. The stanchion lever 13 of the semi-trailer truck 16 is pivotally connected to the stanchion 14 on a horizontal axis and, as shown in FIGS. 1 through 4, is flat on the side near the secured door 17 and is flat on the side facing away from the door 17. As shown in FIGS. 3 and 4, the lever 13, in its locking position, is nested in an upwardly open recess 18 of a locking flange 21 projecting from the exposed side of a latch plate 22 secured to the door 17 by bolt like fasteners 23, 24. The stanchion lever 13 is secured in its illustrated door locking position by a retainer latch 26 pivotally connected to the latch plate 22 by the fastener 24. The locking flange 21 and the pivotable retainer latch 26 have vertically alignable annular openings 31, 32, respectively, in their locking positions, through which a shackle 33 of a padlock 34 extends, as shown in FIG. 6, to maintain the lever 13 in its stanchion locking position. As illustrated in FIGS. 1 through 7 and 10 the lock guard 11 has a housing which includes a vertical front wall 41, a pair of parallel vertical side walls 42, 43 rigidly secured to and extending rearwardly at right angles from the front wall 41, a double pitched roof 46 rigidly secured to the upper ends of the front wall 41 and the side walls 42, 43. The laterally opposite sides of the roof slope upwardly from the sidewalls 42, 43 at 45 degree angles converging in a fore and aft extending peak. The sloping roof 46 is designed to deflect sledge hammer blows impacted by thieves. As shown in FIGS. 3 and 7, side wall 42 includes a bottom open rectangular notch 52 at its lower rear corner and as shown in FIGS. 4 and 10 side wall 43 includes a similar notch 53 at its lower rear corner. The bottom open notches 52, 53 accommodate the lever 13 when the lock guard 11 is in its installed position, as shown in FIGS. 3 and 4. The lock guard 11 is also provided with a partial bottom floor 56 which may have a central notch 57 at its rear end. The horizontal bottom floor 56 is rigidly secured at its front and laterally opposite sides to the front wall 41 and side walls 42, 43. The partial bottom floor 56 limits access and reinforce the side walls 42, 43. The notch 57, if included, accommodates the case 35 of the long shackle padlock 34. The lock guard 11 includes a horizontal retainer tab 61, rigidly secured to the front wall 41 and the side walls 42, 43, which has an annular vertical opening 62 for reception of the shackle 33 of the padlock 34. A horizontal abutment or abutment plate 66 is rigidly secured to the walls 41, 42, 43 and is disposed above the retainer tab 61 so as to provide an abutment which is engaged by the shackle 33 when it is desired to lock the padlock 34 in its installed condition shown in FIG. 4.

As shown in FIGS. 2, 3 and 4, the lock guard 111 surrounds and protects the latch plate 22 and the pivoted retainer latch 26 as well as the padlock 34. As shown in FIG. 2, the lock guard 11 is horizontally wider than the latch plate 22 and the retainer 26 latch in its illustrated locking position. A pair of L-shaped brackets 71, 72 have horizontal legs 73, 74 welded to the laterally outer sides of the side walls 42, 43, respectively. The horizontal legs 73, 74 are in horizontal alignment with, and are structurally an extension of, the retainer tab 61. The L-shaped brackets 71, 72 at the rear of the lock guard housing have downwardly extending vertical legs 76, 77 which are insertable vertically downward behind the stanchion lever 13, thereby retaining the lock guard 11 close to the door 17 in a protective position relative to the padlock 34, the latch plate 22 and the pivotable retainer latch 26. The legs also resist attempts to remove the lock guard 11 by pry bars. The horizontal legs 73, 74 of the brackets 71, 72 also reinforce the side walls 42, 43 and the retainer tab 61. The lock guard 11 is designed for use with either the illustrated long shackle padlock 34 or a regular length shackled padlock, not shown. A vertically elongated slot 81 is provided in the front wall 41 in which the shackle 33 of the long shackle padlock 34 is temporarily inserted, in order to permit the unhinged leg of the shackle 33 to be inserted in the opening 62 in the retainer tab 61, while retaining succinctness and restricting the normal expansion of lock guard 11 to accommodate such length lock guard shackle 33. The slot 81 is slightly wider than the diameter of the shackle 33, but too narrow for an adult human finger.

Figure 8:
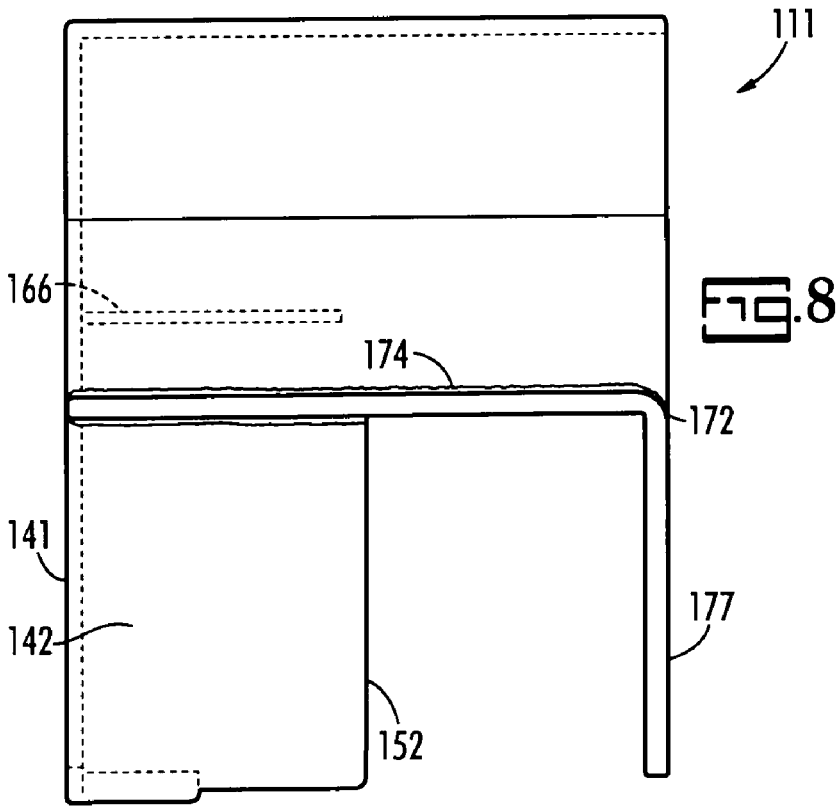
FIG. 8 is a side view of a second embodiment lock guard.
Figure 9:
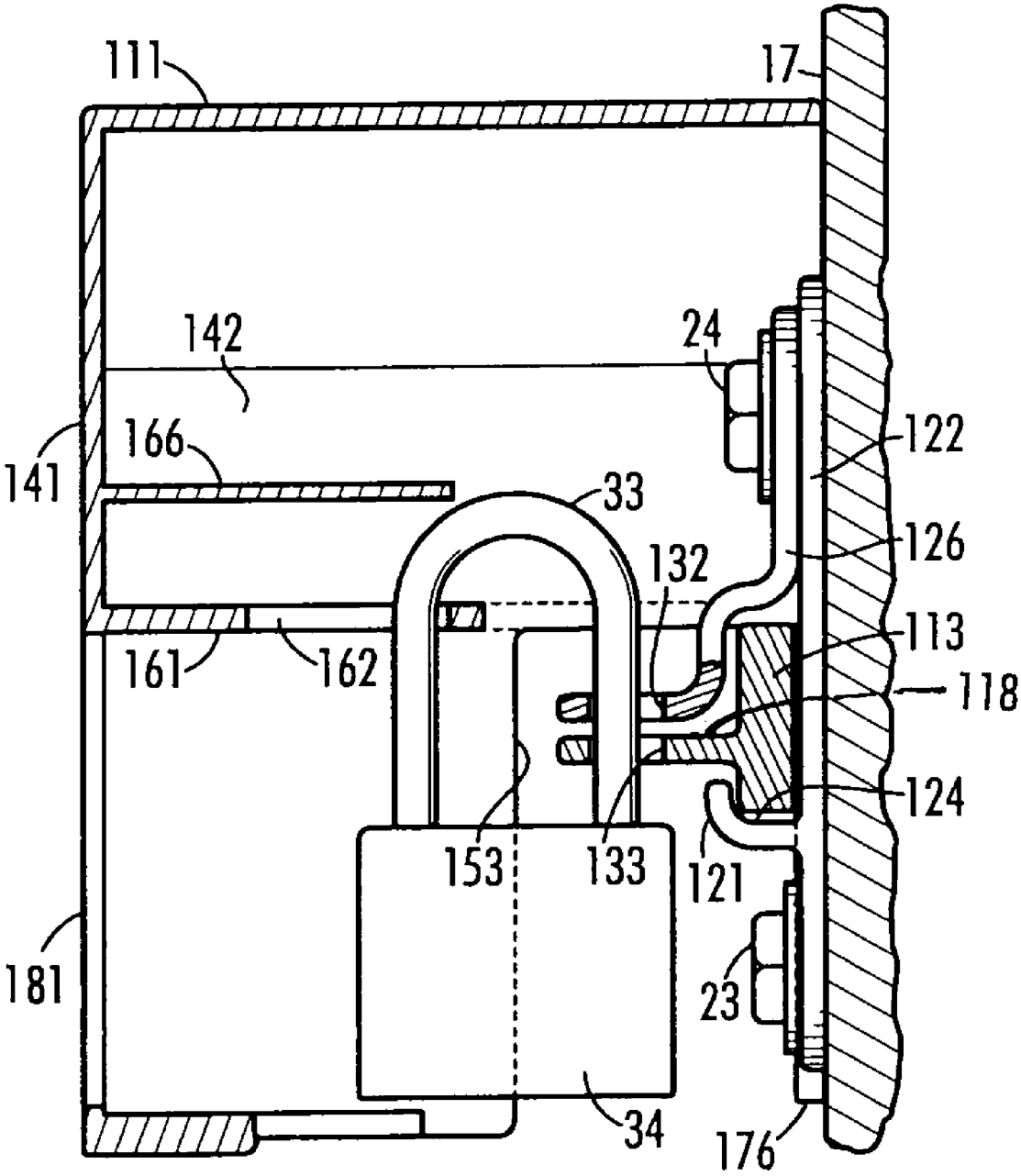
FIG. 9 is a vertical section showing the lock guard of FIG. 8 installed in a lever securing position.

A second type of stanchion lever 113 shown in FIG. 9, has a horizontally projecting reinforcing ridge 118 with a vertical opening 133. A second embodiment lock guard 111, shown in FIGS. 8 and 9, is particularly suited for use in guarding the padlock 34 used to secure the stanchion lever 113. The presence of the ridge 118 requires notches 152, 153 in the side walls 142, 143 which have a wider horizontal width than the notches 52, 53 of the lock guard 11. In other respects the lock guard 111 is similar to the lock guard 11. The lock guard 111 includes L-shaped brackets 171, 172, similar to brackets 71, 72, which have downward extending legs 176, 177 which hook behind the stanchion lever 113 in the same manner as the legs 76, 77 of the lock guard 11 hooked behind the stanchion lever 13. The latch plate 122 shown in FIG. 9, to which the retainer latch 126 is pivotally connected, includes a locking flange 121 with a pocket 124 for the receiving stanchion lever 113 in its locking position. The pivotable retainer latch 126 and the stanchion lever 113 have alignable openings 132, 133 for reception of the shackle 33 of the padlock 34. The front wall 141 of the lock guard 111 includes a vertically elongated opening 181. Guard 111 also includes a retainer tab 161 with a vertical opening 162 for the shackle 33 of the padlock 34 and an abutment plate 166.

FIG. 10 illustrates the utility of the vertically elongated opening 181 in the front wall 141 of the lock guard 111, whereby the shackle 33 is temporarily placed at least partially in the opening 181 during insertion of the shackle 33 through the opening 162 in the retainer tab 161 in preparation of securing the stanchion lever 113. The shackle 33 is also insertable into the opening 181 when removing the padlock 34 from the lock guard 111. An abutment 166 is rigidly secured to the side walls 142, 143 and the front wall 141 and is disposed above the horizontal retainer tab 161.

Having hereby described the subject matter of the present invention, it should be apparent that many substitutions, modifications and variations of the invention are possible in light of the above teaching. It is therefore to be understood that the invention as taught and described herein is only to be limited to the extent of the breadth and scope of the appended claims.

What is claimed is:

1. A lock guard for a padlock with a shackle locking a stanchion lever to a container closure having a latch plate pivotably supporting a retainer having an opening for reception of the shackle, said lock guard comprising:

a housing including a pair of laterally spaced fore and aft extending vertical side walls, a double pitched roof rigidly secured to the upper ends of said side walls with its peak extending in a fore and aft direction, a vertical front wall, rigidly secured to the forward ends of said side walls and to the forward end of said roof, said front wall including a vertically extending elongated slot too small for fingers but large enough to permit said shackle of said padlock to be partially extended therethrough during attachment of said padlock to and detachment of said padlock from said lock guard, a horizontal locking tab secured to said front and side walls above said slot and extending rearwardly from said front wall, said locking tab including an elongated opening wider than the width of said shackle and sufficiently long to allow rotation of said shackle, a notch in the lower rear corner of each of said side walls, and a pair of L-shaped brackets at laterally opposite sides of said side walls having first corresponding legs rigidly secured to said walls in horizontal alignment with, and structurally an extension of, said locking tab and second corresponding legs at the rear of said guard extending downwardly behind said stanchion lever.

2. The lock guard of claim 1 including an abutment above said locking tab against which said shackle of said padlock is engageable to force said shackle to its locking position.

3. The lock guard of claim 1 wherein said legs are a greater distance apart than the horizontal width of said latch plate.

4. The lock guard of claim 1 including a bottom wall secured to said side and front walls and extending rearward a distance not greater than one half the fore and aft dimension of said roof.

5. A lock guard for a padlock securing a container door stanchion lever in its door latching position wherein the shackle of the padlock is passed through aligned openings in the stanchion lever and a locking latch pivotally supported on a mounting plate secured to the container door, comprising a housing having a vertically extending front wall having a centrally positioned vertically elongated opening having a length longer than the width of said shackle and having a width wider than the diameter of said shackle and too small to permit insertion of an adult human finger, a pair of laterally spaced parallel vertical side walls rigidly secured to and extending rearward from laterally opposite ends of said front wall, a roof rigidly secured to the upper ends of said front and side walls, and a horizontal locking tab secured to at least one of said walls presenting a vertical opening larger than the diameter of said shackle, said housing being open at its rear and at least partially open at its bottom, a pair of L-shaped brackets having corresponding first horizontal legs rigidly secured to the lateral outer sides of said side walls in horizontal alignment with and structural extension of said locking tab providing increased rigidity to said side walls and second corresponding legs extending downwardly from the rear end of said first legs, respectively, and a notch in the lower rear portion of each of said side walls extending from said horizontal leg of said L-shaped bracket to the bottom of said side wall, said second pair of legs being adapted to pass downwardly between said lever and said container door at laterally outer sides of said locking latch and mounting plate.

6. The lock guard of claim 5 wherein said roof is a pitched roof.

7. The lock guard of claim 6 wherein said roof is a double pitched roof having a peak extending in a front to rear direction.

8. A lock guard for a padlock securing a container door stanchion lever in its door latching position wherein the shackle of the padlock is passed through aligned openings in the stanchion lever and a locking latch pivotally supported on a mounting plate secured to the container door, comprising a housing having a vertically extending front wall, a pair of laterally spaced parallel vertical side walls rigidly secured to and extending rearward from laterally opposite ends of said front wall, a double pitched roof rigidly secured to the upper ends of said front and side walls, and a locking tab extending horizontally between and rigidly secured to said side walls presenting a vertical opening larger than the diameter of said shackle, an abutment secured to at least one of said side and front walls and positioned above said locking tab, said housing being open at its rear and at least partially open at its bottom, a pair of L-shaped brackets having corresponding first horizontal legs rigidly secured to the lateral outer sides of said side walls in horizontal alignment with, and structurally an extension of, said locking tab and second corresponding legs extending downwardly from the rear end of said first legs, respectively, and a notch in the lower rear portion of each of said side walls, said notches, extending from said horizontal legs of said L-shaped bracket to the bottoms of said side walls, respectively, said second pair of legs being adapted to pass downwardly between said lever and said container door at laterally outer sides of said locking latch and mounting plate.

9. The lock guard of claim 8 wherein said roof has a peak extending in a front to rear direction.

10. A lock guard for a padlock with a round section shackle adapted to lock a stanchion lever to a container closure having a retainer pivotally mounted thereon which has an opening for reception of the shackle, said lock guard comprising:

a housing including a pair of laterally spaced fore and aft extending vertical side walls, a double pitched roof rigidly secured to the upper ends of said side walls with its peak extending in a fore and aft direction, a vertical front wall, rigidly secured to the forward ends of said side walls and to the forward end of said roof, said front wall including a vertically extending slot slightly wider than the diameter of said shackle and sufficiently narrow to prevent access by an adult human finger, a horizontal locking tab secured to said side walls above said slot and extending rearwardly from said front wall, including an elongated opening wider than the diameter of said shackle, a notch in the lower rear corner of each of said side walls, and a pair of legs secured to the laterally outer sides, respectively, of said side walls and extending downwardly behind said stanchion lever, said housing being disposed in protective relation to said padlock and said retainer.

* * * * *